United States Patent [19]

Zacky et al.

[11] Patent Number: 4,625,483

[45] Date of Patent: Dec. 2, 1986

[54] CONNECTOR SYSTEM FOR FURNITURE PANELS

[75] Inventors: Ralf G. Zacky, Los Angeles; Gordon L. Alexander, Sylmar, both of Calif.

[73] Assignee: Aspects, Inc., Sun Valley, Calif.

[21] Appl. No.: 740,221

[22] Filed: Jun. 3, 1985

[51] Int. Cl.[4] ..... E04B 2/74; E04C 2/38

[52] U.S. Cl. ..... 52/239; 52/282; 52/284; 52/582

[58] Field of Search ..... 52/36, 238.1, 239, 282, 52/284, 285, 288, 287, 278, 582, 584, 578–581; 160/130, 351

[56] References Cited

U.S. PATENT DOCUMENTS

| | | | |
|---|---|---|---|
| 3,282,006 | 11/1966 | Halsey et al. | 52/239 X |
| 3,425,171 | 2/1969 | Propst et al. | 52/239 X |
| 3,428,108 | 2/1969 | Singer | 52/239 X |
| 3,430,997 | 3/1969 | Propst et al. | 52/239 X |
| 3,624,780 | 11/1971 | Elliott | 52/36 |
| 3,713,257 | 1/1973 | Beavers | 52/36 |
| 4,047,342 | 9/1977 | Boulva | 52/239 |
| 4,185,430 | 1/1980 | Gartung | 52/239 X |
| 4,186,533 | 2/1980 | Jensen | 52/285 X |
| 4,269,005 | 5/1981 | Timmons | 52/239 X |
| 4,443,986 | 4/1984 | Propst et al. | 52/239 |

FOREIGN PATENT DOCUMENTS

| | | | |
|---|---|---|---|
| 2060022 | 4/1981 | United Kingdom | 52/239 |
| 1600990 | 10/1981 | United Kingdom | 52/238.1 |

*Primary Examiner*—John E. Murtagh
*Assistant Examiner*—Richard E. Chilcot, Jr.
*Attorney, Agent, or Firm*—Charles H. Schwartz; Ellsworth R. Roston

[57] ABSTRACT

A panel system including a universal connector, including first and second panel members each having a rail member attached vertically along one side edge of the panel members. The rail members including at least one cavity extending along the vertical axis of the rails. The first and second panel members are positioned adjacent each other to have the rail members positioned adjacent each other. Two universal connectors for interconnecting the panels to each other at top and bottom positions. The connectors include a horizontal body portion and at least two leg numbers extending perpendicularly from the body portion and with each of the leg members for insertion into the one cavity of a rail member for interlocking the connector to either or both of the rail members. A flange portion extending perpendicularly from the body portion and with the flange portion including a locking member for locking to the rail member in a direction perpendicular to the vertical axis of the rail member and the body portion including a locking member for locking to the rail member in a direction along the vertical axis of the rail member.

24 Claims, 9 Drawing Figures

12
68
22
14
10
18
16
68
68
20
24

12
28
54
62
14
56
42
60
50

12
66
50
14
60
56
54
5
5
54
56
62
42
60
50

CONNECTOR SYSTEM FOR FURNITURE PANELS

BACKGROUND OF THE INVENTION

1. Field of the Invention

The present invention relates to a connector system for interconnecting furniture panels. Specifically, the connector system of the present invention requires only one universal connector to connect panels to panels and/or, panels to uprights to provide for two (2), three (3), or four (4) way panel connections of different angular configurations.

2. Description of the Prior Art

There are a large variety of panel connector systems for providing interconnection between free standing panels. Some of these systems require that each panel be interconnected to an adjacent panel through the use of a post member. The present invention is directed to a system that does not require the use of a post member, although uprights may be used so as to provide for the interconnection between panels at angular relations to each other and/or the interconnection of more than two panels to each other.

Prior art panel connectors are generally complicated in structure. In addition, prior art systems often require the use of more than one type of panel connector, dependent upon the specific desired panel configuration. Other problems with some prior art panel connector systems is that they require that the panels be either turned over or tilted up a considerable distance in order to attach connectors to the bottom of the panels before the panels may be interlocked to each other. Other difficulties with particular types of prior art panel systems is that they use plastic connectors to provide for the interconnection between panels.

It will be appreciated that the various types of prior art systems described above have a number of deficiencies. For example, prior art connectors may not be rigid if they are constructed of plastic. Also, the panels may not be easily assembled if the panels have to be turned over or tilted to attach the connector. In addition the panels may be difficult to assemble if different types of panel connectors are used for different panel configurations. The present invention is directed to a panel connector system which uses a universal connector to eliminate the deficiencies in the prior art structures.

SUMMARY OF THE INVENTION

The present invention relates to a panel system using a universal panel connector. The universal connector interconnects panels to each other and also attaches panels at angular relations to each other using an upright member. The identical universal connector is used both at the top and bottom of the panels which simplifies the operation of panel assembly. In addition, the universal connector can be inserted into the bottom of the panel without turning or tilting the panel over.

Other advantages of the universal connector of the present invention is that the connector is made of metal and therefore provides for a rigid interconnection between the various panel members. The panel connector is concealed within the panel structure so that once the panels are interconnected to each other, a cap member may be used at the top of the panels to provide for a completely smooth, flush, visual appearance for the panel assembly.

The universal connector includes locking means located ninety degrees (90°) to each other. In particular, the connector may include a flange portion having a first opening to receive a screw member to lock the connector to a rail member attached to a side edge of the panel. The opening and the screw member is perpendicular to the rail coupled along the edge of the panel. Once a first one of the universal connectors is locked in position at the bottom of the panel, then an adjacent panel may be interlocked with the first connector and an identical second universal connector is positioned at the top of the panels to interlock the panels together. The universal connector includes a body portion at ninety degrees (90°) to the flange portion and with the body portion having a second opening to receive a screw member. The universal connector at the top of the panel may be locked in position by the second screw member which is received in the rail and with the screw member being vertical to the rail.

When the panels are held together by universal connectors at the bottom and top of the panels, the connectors provide for an automatic leveling between the panels since the connectors at the top and the bottom are preferably attached to the same rail which is in turn attached to one particular panel. The other panel is therefore either raised or lowered when the top connector is locked in place, so as to provide for the automatic leveling between adjacent panels or between a panel and an upright member.

The universal connectors may include leg members which are received in integral cavities in the rails so as to interlock an individual connector to a rail and with the screw members rigidly connecting a connector to one of the rails.

BRIEF DESCRIPTION OF THE DRAWINGS

A clear understanding of the present invention will be had with reference to the following description and drawings wherein.

DESCRIPTION OF THE PREFERRED EMBODIMENT

Figure 1:
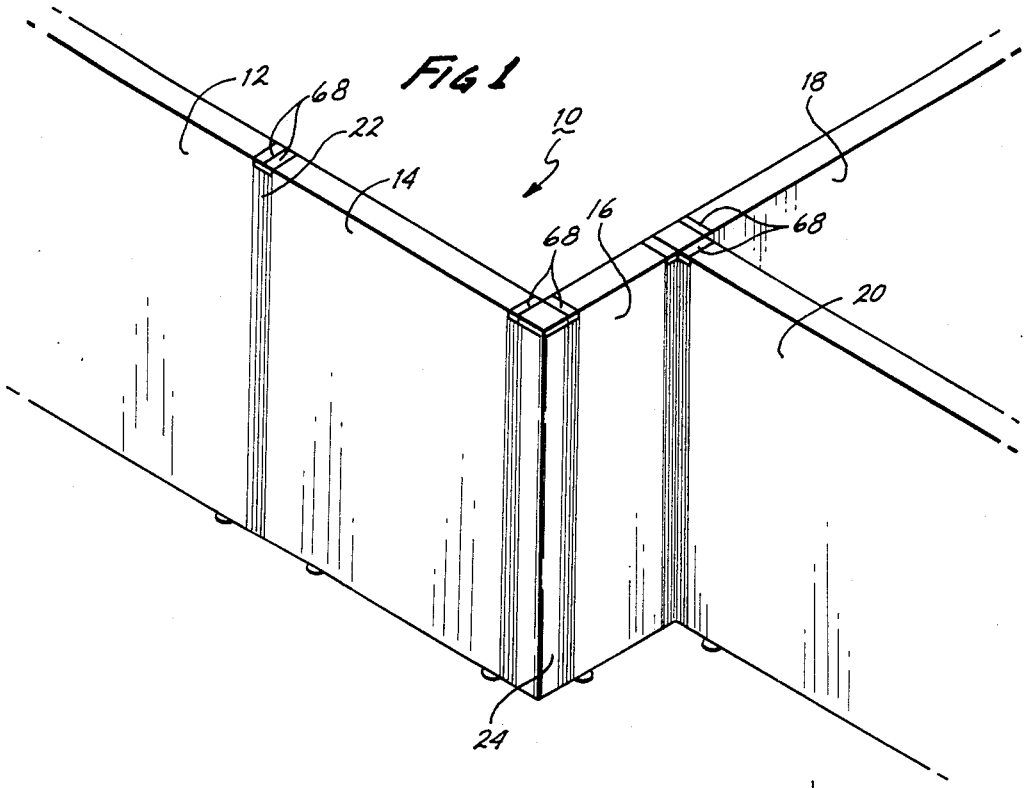
FIG. 1 is a front perspective view of a panel system incorporating the universal connector of the present invention and showing various panel arrangements.

As shown in FIG. 1, a panel system 10 may include a variety of panel members 12, 14, 16, 18, and 20, all interconnected in a variety of angular relationships. Specifically, panels 12 and 14 are connected in line at a joint 22. Panels 14 and 16 are connected at right angles to each other and, specifically, both panels are connected to each other through an upright member 24. Panels 16 and 18 are connected in line through an upright member 26 and with a panel 20 being at ninety degrees (90°) to both panels 16 and 18 and also being connected to those panels through the upright 26. The uprights 24 and 26 may be essentially the same and with up to a total of four (4) panels connected to the upright, all at ninety degrees (90°) to each other. Other uprights may be used, having angular sides other than at a ninety degree (90°) angle so as to provide for panel members being interconnected at angular relationships other than ninety degrees (90°) to each other. For example, an upright may be provided with three (3) equal angular sides, providing panel members being disposed at a hundred and twenty degrees (120°) relative to each other.

Figure 2:
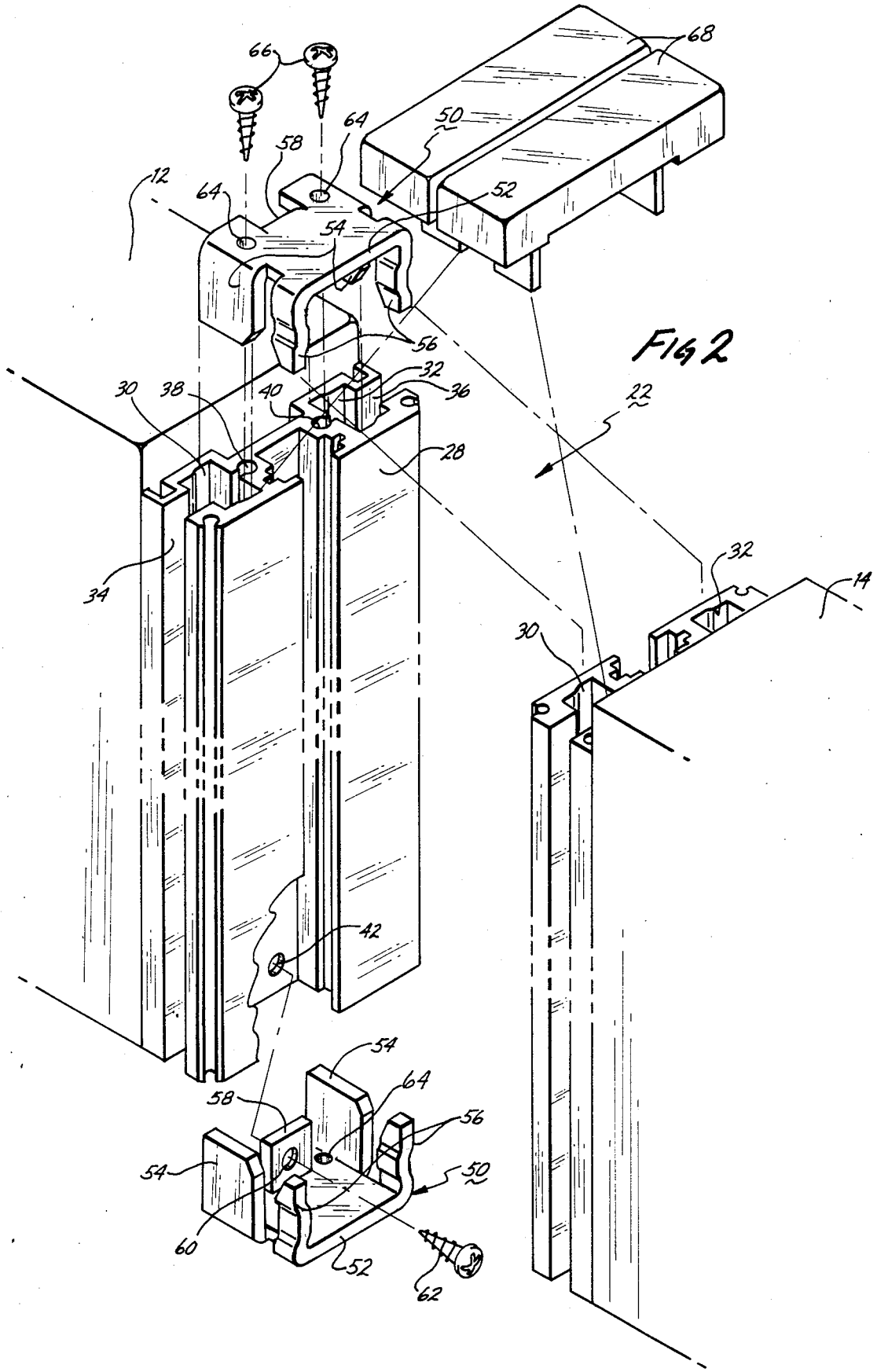
FIG. 2 is an exploded view of a pair of adjacent panel members and showing identical universal connectors at top and bottom positions to interconnect panels to each other.

FIG. 2 illustrates two adjacent panel members, such as panel members 12 and 14, interconnected in line at the joint 22. Attached to each side edge of each panel member is an identical rail member 28. Each rail member may be made of an extruded material such as an extruded aluminum, but it is to be appreciated that the rail member may be made of other materials. The rail members may be attached to the edges of the panels using any appropriate means, such as screws, staples, adhesives, etc.

Each rail member is formed with a plurality of elongated cavities so as to accomodate various functional aspects of the panel system and also to reduce the weight of the rail member. In particular, the rail member 28 includes cavities 30 and 32 and with openings 34 and 36 leadin into these cavities. The cavities 30 and 32 may be used to receive and support various bracket members to allow for different types of structures to be hung from the panel system. For example, the panel system may be used to support an extensive array of components such as hanging shelves, worktop supports, reception counters, task lights, hanging drawers, cabinets, etc. Leading off from the cavities 30 and 32 are further openings 38 and 40, which openings are designed to receive threaded members, such as self tapping screws. The rails 28 also include, at a bottom position, an opening 42, also designed to receive a self tapping screw. The opening 44 is perpendicular to the openings 38 and 40.

The cavities 30 and 32, the openings 38 and 40, and the opening 42, are all designed to receive, support and lock a universal connector 50 to the rail member 28. Identical universal connectors 50 are used at the top and bottom of the panel structure and are used to interconnect between adjacent inline panels and panels that are connected at angular relationships to each other through uprights.

As shown in FIG. 2, each connector includes a body portion 52 and with two (2) sets of leg members extending from the body portion 52 at ninety degrees (90°) to the body portion. In particular, a first set of leg members 54 extend from the body member 52 and a second set of leg members 56 extend from the body portion 52. The leg members 54 are wider than the leg members 56. In addition to the leg members 54 and 56, a flange portion 58 also extends from the body portion 52, again at a ninety degree (90°) angle to the body portion 52. The flange portion 58 includes an opening 60 and a first self tapping screw member 62 passes through the opening 60. A pair of openings 64 are provided in the body portion 52 and a pair of self tapping screw members 66 pass through the openings 64. As shown in FIG. 2, cap members 68 may be used to cover over the top of the connector structure after assembly to provide a uniform extension of the top of the panels 12 and 14.

Figure 3:
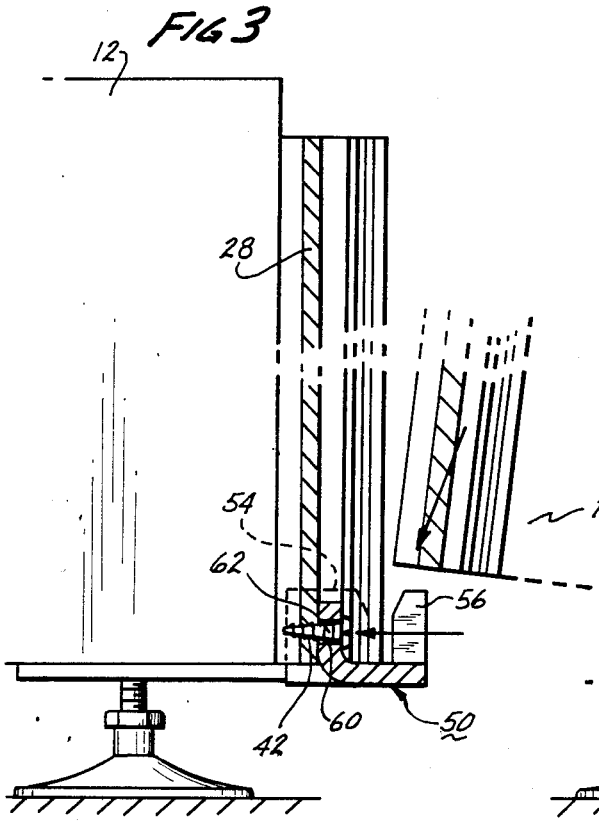
FIG. 3 illustrates a first step in the assembly of adjacent panels where the connector is attached to the bottom of a panel prior to the interlocking of an adjacent panel.
Figure 4:
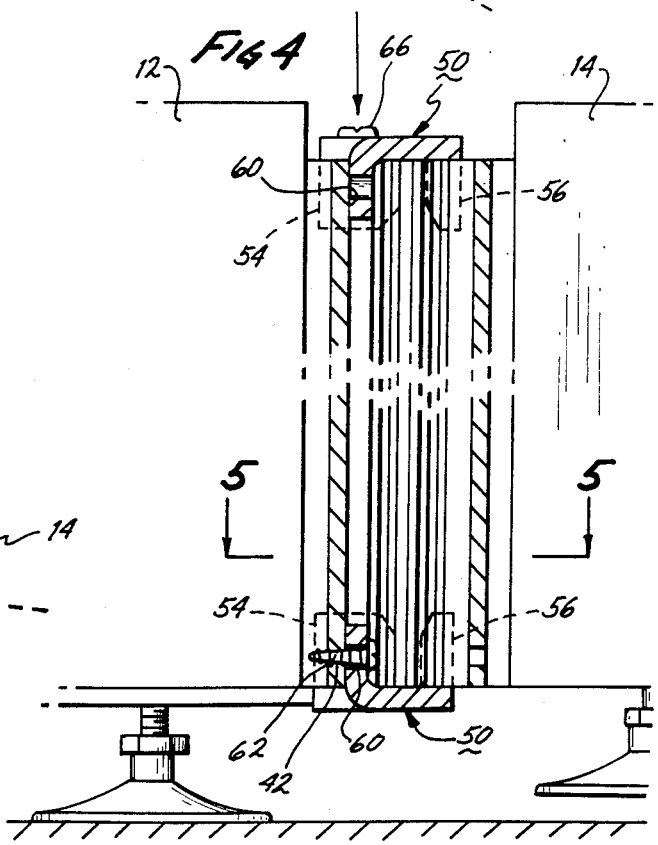
FIG. 4 is a second step in the interconnection of adjacent panels where the top connector is positioned to interlock adjacent panels.

FIGS. 3 and 4 illustrate the assembly of the panel members 12 and 14 in line with each other. The initial step in the assembly is to insert one of the universal connectors 50 at a bottom position so that the leg members 54 are received in the cavities 30 and 32 at the bottom of the rail member 28. In this position the opening 60 in the flange 58 lines up with the opening 42 in the rail member. This can be seen in FIG. 3. The screw member 62 may then be inserted through the opening 60 and screwed into the opening 42, using the self tapping structure of the screw 62.

The connector 50 is therefore locked into the bottom of the rail 28 and is rigidly held in position, since the legs 54 are captured in the cavities 30 and 32 and since the screw member 62 is threaded into the opening 42. At this time the adjacent panel 42 may be positioned above the connector 50 to have the leg members 56 enter into the cavities 30 and 32 in the adjacent rail member. The panel 14 may be pushed downward to seat the leg members 56 within the cavities 30 and 32 as shown in FIG. 4. Another one of the universal connectors 50 may now be positioned at the top of the rail members 28 to have the leg members 54 and 56 enter into the cavities 30 and 32 in the adjacent rail members 28 attached to the panels 12 and 14. This again may be seen in FIG. 4.

The opening 60 in the rail member does not enter into the locking arrangement when the connector is used at a top position, but the openings 64 are used to receive the self tapping screws 66. In particular, once the leg members 54 and 56 are seated into the cavities 30 and 32 in the adjacent rail members, then the screw members 66 may be positioned through the openings 64 to be received within the openings 38 and 40 of the rail member 28. The self tapping screws 66 are then threaded into the openings 38 and 40 to lock the connector 50 at the upper position.

It should be noted that the legs 54 in both the lower and upper connectors 50 preferably are positioned within the cavities 30 and 32 of the same rail member 28. This insures that as the screw members 66 are fully seated into the openings 38 and 40, the panel member 14 is brought into automatic alignment with the panel member 12. This is because the panel 14 will be positioned to be held between the universal connectors 50 at the top and bottom when the top connector is fully screwed down using the screws 66.

It can also be seen that the assembly of the panels is accomplished without having to turn over any of the panels or to severely tilt the panels in order to insert the bottom connector. The bottom connector is inserted and is locked in place with a screw member which passes through the rail at a ninety degree (90°) angle to the rail. When the second panel member is locked in position by the top connector 50, this top connector is then locked in position by screw members which pass into the rail along the same vertical axis as the rail. The connector, therefore, includes the locking means at ninety degrees (90°) to each other to allow for the simple assembly of the top and bottom connectors to the rail members and therefore the simple assembly of the panel members to each other.

Figure 5:
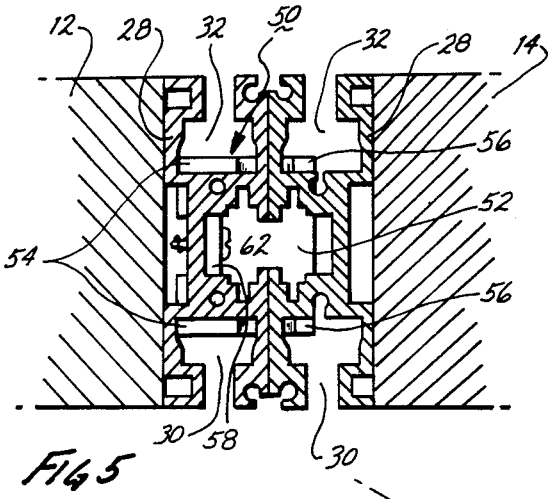
FIG. 5 is a cross-sectional view taken along lines 5—5 of FIG. 4.
Figure 6:
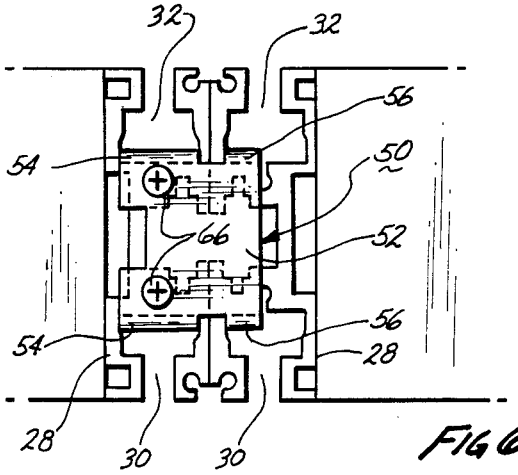
FIG. 6 is a top view of FIG. 4.
Figure 7:
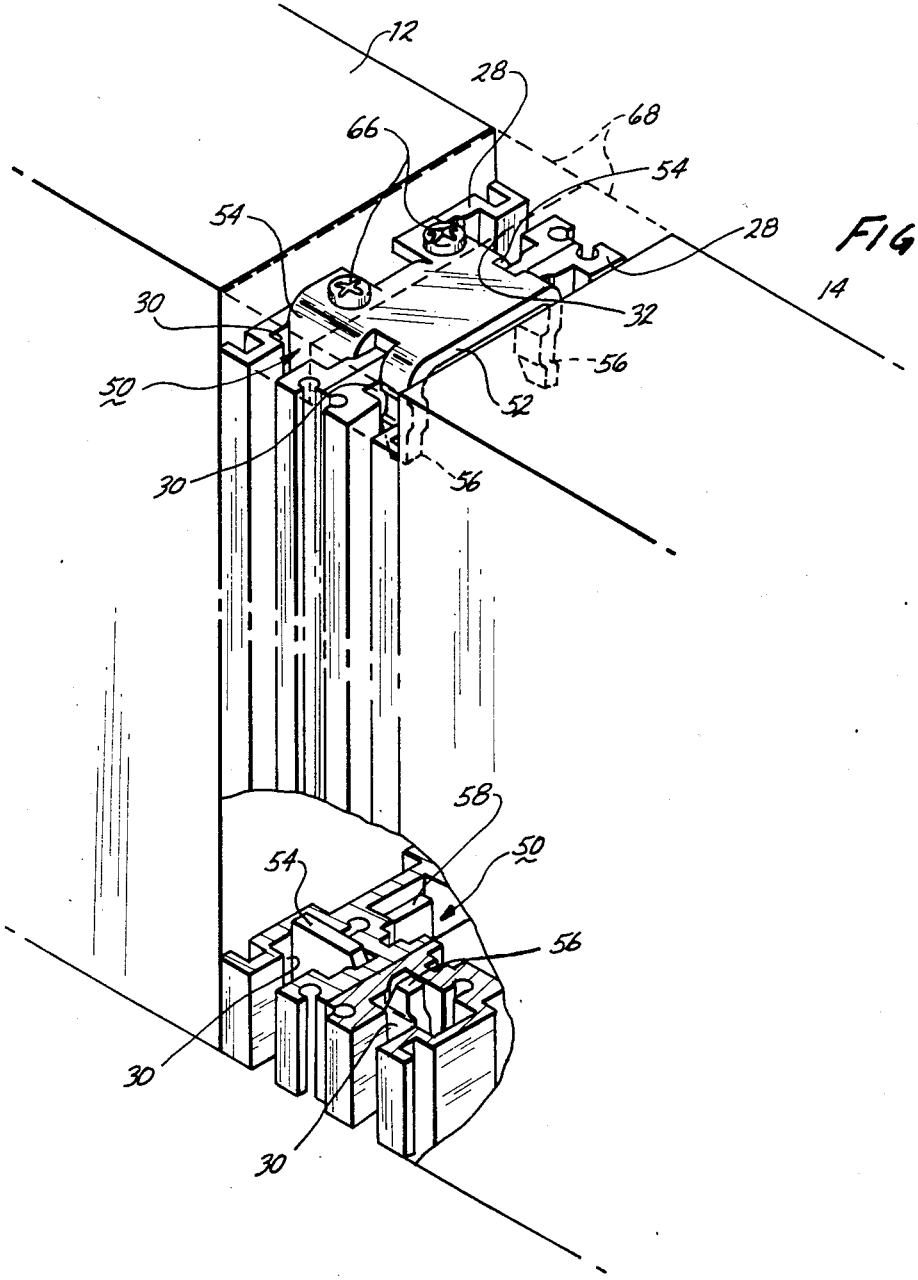
FIG. 7 is a perspective view, partially broken away, showing the adjacent panels interlocked to each other.

FIGS. 5, 6 and 7 illustrate the assembly of the panels 12 and 14 in the fully assembled state. FIG. 5 is a cross-sectional view taken along lines 5—5 of FIG. 4 and illustrates the lower connector 50 interconnecting the rail members 28 and with the leg members 54 and 56 fitted within the cavities 30 and 32 and with the bottom connector 50 locked in position by the screw member 62. FIG. 6 illustrates a top view of FIG. 4 and illustrates the upper connector 50 in position to intercouple the rails 28 and specifically, with the legs 54 and 56 positioned within the cavities 30 and 32 and with the connector locked in position by the screw members 66. FIG. 7 again illustrates the panels 12 and 14 coupled together and shows in the partially broken away position, the lower connector 50 locked in position and the upper connector 50 also locked in position.

Figure 8:
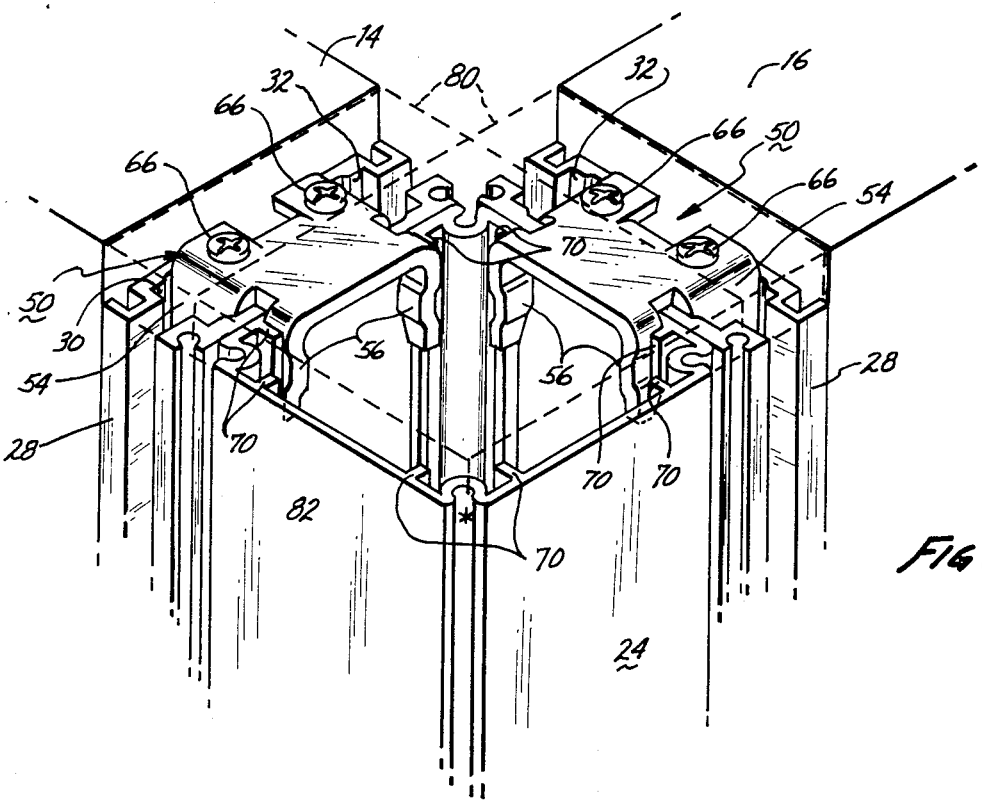
FIG. 8 illustrates panel members connected at ninety degree (90°) angles to each other and using an interconnecting upright member.
Figure 9:
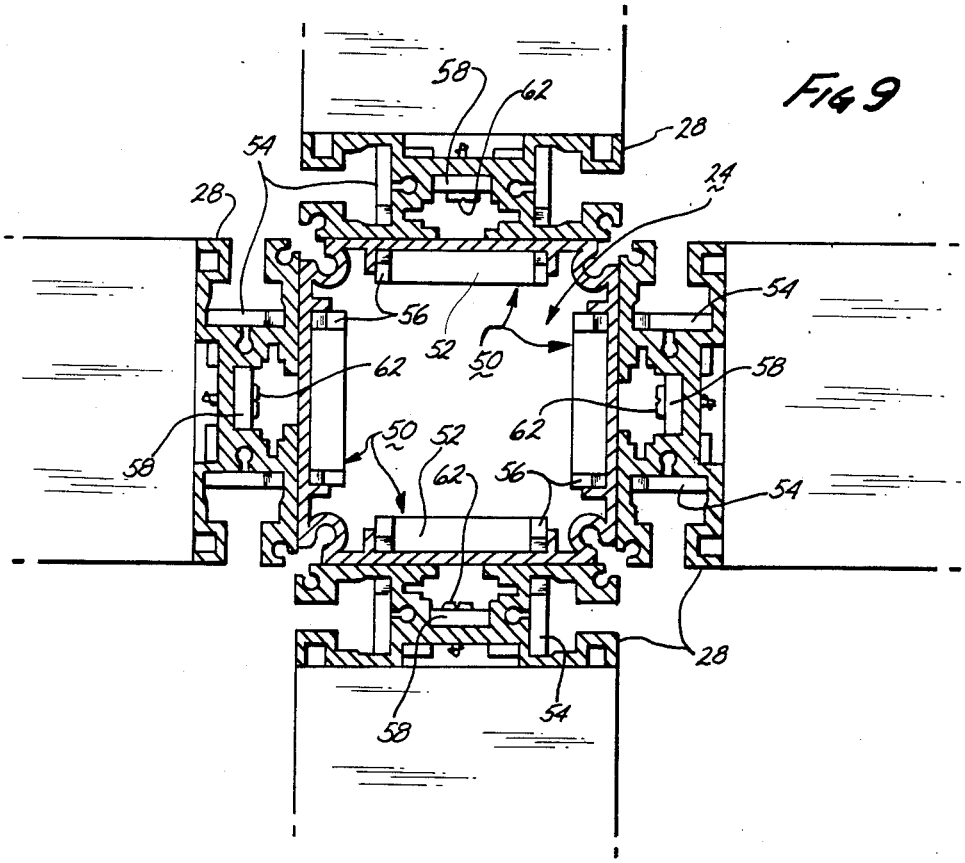
FIG. 9 illustrates four (4) panel members connected at ninety degree (90°) angles to each other, again using an upright member as the interconnecting member.

FIG. 8 illustrates the panel members 14 and 16 arranged at a ninety degree (90°) angle relative to each other and using an upright 24 to provide for the angular arrangement of the panels relative to each other. The upright 24 includes internal ribs 70 extending on the inner surface of all four (4) sides of the upright. The ribs 70 are formed to position and guide the legs 56 of the connectors 50. The other leg members 54 are positioned in the openings 30 and 32 of the rail 28 and with the screw member 66 locking the connectors 50 to the rails and therefore the panels to the upright 24. It can be seen that the upright 24 can accomodate up to four (4) panel members and as shown in FIG. 9, the upright 24 is shown accommodating four (4) panel members radiating from all four (4) sides of the upright. FIG. 9 is actually a cross-sectional view showing the connectors 50 in a bottom position locking to the bottom of the rails 28 using the screw members 62.

It is to be appreciated that uprights may be configured to support panel members at other angular arrangements other than ninety degrees (90°) so that panel members may be positioned at other angular arrangements to each other. In addition, the uprights may support radiating panels from less than all of the sides of the upright. For example, FIG. 1 illustrates the upright 26 having panels 16, 18 and 20 radiating from three sides.

The universal connectors 50 may therefore provide for the interconnection of panels to panels in line, or may provide for the interconnection of panels at various angular relations to each other through the use of intermediate upright members. The same connector is used at the top and bottom and the connectors are preferably made of metal, such as steel, so as to provide for a rigid interconnection between a rail member attached to the edge of a panel and an adjacent rail member or an adjacent upright member. The connectors are locked in positions with locking attachment means such as screws and with the connector including a flange portion having one screw opening to allow for the connector to be attached to the rail and locked in place with the screw member threaded into the rail at a ninety degree (90°) angle. The connector also has a body portion having openings to receive screw members which are received in the rail members with the screw members threaded into the rail along the vertical axis of the rail. The connector therefore has the screw openings in the flange portion and body portion at ninety degrees (90°) to each other to provide for the locking of the connector at the bottom and top of the rail without having to turn the panels over or tilt up the panel.

In operation, a first connector is placed in position at the bottom of the rail and the screw member inserted through the opening in the flange portion of the connector to thread into the rail at a ninety degree (90°) angle. The second panel is then locked in position over a pair of leg members and the top of the rails are locked together with an identical second universal connector in the upper position and with the screw members passing through the body portion of the connector and threaded into the rail along the vertical axis of the rail. As shown in the specification, a similar arrangement is used to interconnect the panels to uprights to provide for various angular relationship between the panels.

The bottom connectors are essentially hidden within the structure, but the upper connectors would be exposed. The invention therefore provides for the use of cap members such as cap members 68 shown in FIGS. 2 and 7. In addition, as shown in FIG. 8 the cap members 68 may be used to cover over the rails 28 and a square cap member 82 used to cover off the upright 24.

It is to be appreciated that although the present invention has been described with reference to particular embodiments, various adaptations and modifications may be made and the invention is only to be limited by the appended claims.

We claim:

1. A panel system including a universal connector, including a first panel member including at least one rail member attached vertically along one side edge of the first panel member and with the rail member including at least one cavity extending along the vertical axis of the first rail, a second panel member including at least one rail member attached vertically along one side edge of the second panel member and with the rail member including at least one cavity extending along the vertical axis of the second rail and with the first and second panel members positioned adjacent each other to have the first and second rail members positioned adjacent each other, at least two universal connectors for interconnecting the panels to each other and with one connector positioned at the bottom of the rail members and the other connector positioned at the top of the rail members, the connectors including a horizontal body portion and at least two leg members extending perpendicularly from the body portion and with each of the leg members for insertion into the one cavity of a rail member for interlocking the connector to either or both of the rail members, a flange portion extending perpendicularly from the body portion and with the flange portion including locking means for locking to the rail member in a direction perpendicular to the vertical axis of the rail member, and the body portion including locking means for locking to the rail member in a direction along the vertical axis of the rail member.

2. The panel system of claim 1 wherein each rail member includes two parallel cavities extending along the vertical axis of the rail and with each universal connector including two pairs of leg members and with each pair of leg members for insertion into the two parallel cavities.

3. The panel system of claim 1 wherein the locking means for the flange member is formed by an opening through the flange portion in association with a locking screw passing through the opening and screwed into the rail member.

4. The panel system of claim 1 wherein the locking means for the body portion is formed by at least one opening through the body portion in association with at least one locking screw passing through the opening and screwed into the rail member.

5. The panel system of claim 1 wherein the first and second panel members are disposed in line to have the rail members abut each other and with the universal connectors directly interconnecting the rail members to each other.

6. The panel system of claim 1 additionally including an upright member having a number of elongated sides and with the upright member including at least one internal cavity extending along the vertical axis of the upright and with the first and second panel members disposed adjacent two sides of the upright to have the rail members abut the two sides of the upright and with the universal connectors interconnecting the rail members to the upright by having separate leg members inserted into the cavities of the rail members and into the at least one cavity of the upright.

7. The panel system of claim 6 wherein the upright is rectangular and the panel members are disposed adjacent opposite sides of the upright to have the panels arranged in line.

8. The panel system of claim 6 wherein the panel members are disposed adjacent adjacent sides of the upright to have the panels arranged in angular relation to each other.

9. The panel system of claim 6 wherein the upright is rectangular and the panel members are disposed adjacent adjacent sides of the upright to have the panels arranged ninety degrees (90°) to each other.

10. The panel system of claim 6 wherein the upright is formed as a tubular member to provide a central cavity and including internal ribs to form guides to position the leg members inserted into the cavity.

11. The panel system of claim 6 additionally including at least one cap member to enclose the universal connectors at the top of the rail members.

12. The panel system of claim 1 additionally including at least one cap member to enclose the universal connector at the top of the rail members.

13. A universal connector for use with a panel system including first and second panel members each having a rail member attached vertically along one side edge of the panels and with each rail member including at least one cavity extending along the vertical axis of the rail and with the first and second panel members positioned adjacent each other to have the rail members positioned adjacent each other, the universal connector for interconnecting the panels to each other and with one connector positioned at the bottom of the rail members and the other connector positioned at the top of the rail members, each connector including:

a horizontal body portion and at least two leg members extending perpendicularly from the body portion and with each of the leg members for insertion into the one cavity of a rail member for interlocking the connector to either or both of the rail members, a flange portion extending perpendicularly from the body portion and with the flange portion including locking means for locking to the rail member in a direction perpendicular to the vertical axis of the rail member, and the body portion including locking means for locking to the rail member in a direction along the vertical axis of the rail member.

14. The universal connector of claim 13 wherein each rail member includes two parallel cavities extending along the vertical axis of the rail and with each universal connector including two pairs of leg members and with each pair of leg members for insertion into the two parallel cavities.

15. The universal connector of claim 13 wherein the locking means for the flange member is formed by an opening through the flange portion in association with a locking screw passing through the opening for screwing into the rail member.

16. The universal connector of claim 13 wherein the locking means for the body portion is formed by at least one opening through the body portion in association with at least one locking screw passing through the opening for screwing into the rail member.

17. The universal connector of claim 13 wherein the first and second panel members are disposed in line to have the rail members abut each other and with the universal connectors directly interconnecting the rail members to each other.

18. The universal connector of claim 13 wherein the panel system additionally includes an upright member having a number of elongated sides and with the upright member including at least one internal cavity extending along the vertical axis of the upright and with the first and second panel members disposed adjacent two sides of the upright to have the rail members abut the two sides of the upright and with the universal connectors interconnecting the rail members to the upright by having separate leg members inserted into the cavities of the rail members and into at least one cavity of the upright.

19. The universal connector of claim 18 wherein the upright is rectangular and the panel members are disposed adjacent opposite sides of the upright to have the universal connectors connect the panels in line.

20. The universal connector of claim 18 wherein the panel members are disposed adjacent adjacent sides of the upright to have the universal connectors connect the panels in angular relation to each other.

21. The universal connector of claim 18 wherein the upright is rectangular and the panel members are disposed adjacent adjacent sides of the upright to have the universal connectors connect the panels ninety degrees (90°) to each other.

22. The universal connector of claim 18 wherein the upright is formed as a tubular member to provide a central cavity and includes internal ribs to form guides to position the leg members inserted into the cavity.

23. The universal connector of claim 18 additionally including at least one cap member to enclose the universal connectors at the top of the rail members.

24. The universal connector of claim 13 additionally including at least one cap member to enclose the universal connector at the top of the rail members.

* * * * *